US006158646A

United States Patent [19]

Calvo, Sr. et al.

[11] Patent Number: 6,158,646

[45] Date of Patent: Dec. 12, 2000

[54] WELD BEAD CHOPPER

[75] Inventors: Julio Calvo, Sr.; Jose Asensio, both of Brampton, Canada

[73] Assignee: Empire Precision Tooling Inc., Brampton, Canada

[21] Appl. No.: 09/209,691

[22] Filed: Dec. 11, 1998

[51] Int. Cl.[7] ..... B23K 31/00

[52] U.S. Cl. ..... 228/125; 228/155; 228/159; 228/160; 228/199; 228/13; 228/19

[58] Field of Search ..... 228/125, 155, 228/159, 160, 199, 13, 19; 219/58, 102, 104

[56] References Cited

U.S. PATENT DOCUMENTS

| | | | |
|---|---|---|---|
| 3,755,884 | 9/1973 | Dupy | 29/481 |
| 3,758,740 | 9/1973 | Dupy | 219/67 |
| 3,927,292 | 12/1975 | Worden | 219/67 |
| 4,622,729 | 11/1986 | Dempsey et al. | 29/33 A |
| 4,752,994 | 6/1988 | Brunken et al. | 29/33 A |
| 5,192,013 | 3/1993 | Abber, III et al. | 228/13 |
| 5,323,949 | 6/1994 | Ruple et al. | 228/125 |
| 5,368,218 | 11/1994 | Omura | 228/19 |

*Primary Examiner*—Patrick Ryan
*Assistant Examiner*—M. Alexandra Elve
*Attorney, Agent, or Firm*—Barrigar & Moss; Robert E. Vernon

[57] ABSTRACT

A weld bead chopper is provided, for use in combination with a scarfing tool which is intended to scarf a longitudinal weld bead from a tube. The chopper has a) a chopper blade which is rotatable about an axis which is substantially perpendicular to a longitudinal axis of the tube, and b) a stationary blade which is cooperable with the rotatable blade. The cooperating chopping surfaces of the rotatable and stationary blades are at a short distance from the weld bead, e.g. less than 100 mm, and preferably from 20 to 50 mm. The scarfed weld bead enters an enclosed throat which has walls to guide a scarfed weld bead towards the cooperating chopping surfaces. The throat has a first guide adjacent to the scarfing tool which directs the scarfed weld bead towards a second guide. The second guide faces the scarfing tool, and is adapted to guide the scarfed weld bead towards the cooperating chopping surfaces. The throat has a cross-sectional area substantially larger than the cross-sectional area of the scarfed weld bead. Additionally, the throat has a mouth which is sufficiently small to prevent the scarfed weld bead from exiting from the mouth.

21 Claims, 3 Drawing Sheets

WELD BEAD CHOPPER

FIELD OF THE INVENTION

The present invention relates to a chopper for chopping a weld bead. In particular it relates to a chopper for chopping weld beads which have been scarfed from the external surface of a longitudinally welded tube.

BACKGROUND TO THE INVENTION

It is known to use a scarfing tool to remove excess weld material from a longitudinally welded metal tube. The scarfed weld material comes off in a strip, which is very hot and, in places, razor sharp. Methods have been used to collect the strip and at the same time to prevent the strip from flailing about. Typically, the hot strip is wound onto a spool on a winder, as disclosed for example in U.S. Pat. No. 5,368,218, which issued Nov. 29, 1994 to Kazuo Omura. When the spool is full, the strip accumulation process must be stopped, and the strip must be cut so that the now-heavy full spool, or the wound strip, can be removed from the winder. To restart the strip accumulation process, a newly formed strip must be fed onto the winder. At start up of the scarfing process, at spool changing time and at other times when there is a break in stripping process, e.g. skipping over a butt weld, an extremely hot and sharp end of the bead must be manually manouevered towards the winder by an operator, e.g. with pincers. This requires much skill, partly because the hot, sharp strip has a tendency to curl unpredictably. As a result, it is not unusual for accidents to occur and the operator to be lacerated and/or burned.

Other methods of dealing with the scarfed strip have been attempted. One method uses an angled scarfing tool and the scarfed strip is directed into a crusher beneath the tube, so that the strip is torn into pieces and dumped into a machine-moveable hopper. This overcomes the problem of moving a heavy, hot reel of wound strip. However, this method, and others like it, still require manual feeding of an end of the strip in order to start the disposal process. For safety reasons, an automatic strip feeding device is highly desirable. One such device is disclosed by in the aforementioned U.S. Pat. No. 5,368,218. Notwithstanding the apparent appeal of this chopping device, it is not being used commercially. It is believed that one of the reasons is the ease with which the slotted guide in the apparatus can become jammed, particularly by light gauge scarfed weld bead, because of the unpredictable spiral curliness of the bead as it leaves the scarfing tool. Another disadvantage of Omura apparatus is that the cut chips of weld bead are expelled from the cutter in the direction of the scarfed tube. Since the weld beads are hard, they can cause damage to the tube and to any rolls, e.g. ironing rolls that are located in the vicinity of the chopping device. The present invention is directed to overcoming the shortcomings of previously used apparatus and methods.

SUMMARY OF THE INVENTION

Accordingly the present invention provides a weld bead chopper for use in combination with a scarfing tool which is intended to scarf a longitudinal weld bead from a tube, said chopper having a) a moving and a stationary blade, the cooperating and chopping surfaces of which are a short distance from the weld bead, wherein the motion of the moving blade is in a plane which is perpendicular to a line which passes through a longitudinal axis of the tube and the weld bead, and b) an enclosed throat which has walls to guide a scarfed weld bead towards the cooperating chopping surfaces, said throat having a first guide adjacent to the scarfing tool, for directing scarfed weld bead towards a second guide which faces the scarfing tool and is adapted to guide the scarfed weld bead towards the cooperating chopping surfaces, and wherein the enclosed throat has a cross-sectional area substantially larger than the cross-sectional area of the scarfed weld bead and having a mouth which is sufficiently small to prevent the scarfed weld bead from exiting from a mouth of the throat.

In one embodiment, the moving blade is rotatable about an axis which is substantially perpendicular to a longitudinal axis of the tube.

In another embodiment, the moving blade moves in a reciprocatory manner.

In yet another embodiment, the weld bead chopper has a chute to allow chopped weld bead to exit from the chopper.

In another embodiment, the first guide has a wall which tapers to a sharp edge adjacent to the scarfing tool.

In yet another embodiment, the first guide has a scooped wall adjacent to the scarfing tool.

In another embodiment, the first guide is attached to the scarfing tool and is separate from other walls of the throat.

In yet another embodiment, the first guide forms a part of the throat and is separate from the scarfing tool.

In a further embodiment the distance between the cooperating chopping surfaces and the weld bead on the tube is less than about 100 mm.

In another embodiment, the distance between the cooperating chopping surfaces and the weld bead on the tube is from 20 to 50 mm.

The present invention also provides a process for disposing of a scarfed weld bead from a longitudinally welded tube comprising:

a) scarfing the weld bead from the tube;

b) directing the scarfed weld bead away from the scarfing tool and towards a chopper which has a moving and a stationary blade, the cooperating and chopping surfaces of which are a short distance from the weld bead, wherein the motion of the moving blade is in a plane which is perpendicular to a line which passes through a longitudinal axis of the tube and the weld bead, wherein direction of the scarfed weld bead is accomplished by movement of the scarfed weld bead through an enclosed throat which has walls to guide a scarfed weld bead towards the cooperating chopping surfaces, said throat having a first guide adjacent to the scarfing tool, which directs the scarfed weld bead towards a second guide which faces the scarfing tool and is adapted to guide the scarfed weld bead towards the cooperating chopping surfaces, and wherein the throat has a cross-sectional area substantially larger than the cross-sectional area of the scarfed weld bead and having a mouth which is sufficiently small to prevent the scarfed weld bead from exiting from a mouth of the throat; and c) chopping the scarfed weld bead with the moving and stationary blades.

In one embodiment, the moving blade rotates about an axis which is substantially perpendicular to a longitudinal axis of the tube.

In another embodiment, the moving blade moves in a reciprocatory motion.

In yet another embodiment, the distance between the tube and the chopping surfaces is less than about 100 mm.

In a further embodiment, the distance between the tube and the chopping surfaces are from 20 to 50 mm.

In yet another embodiment, chopped weld bead exits from the chopper through a chute.

DETAILED DESCRIPTION OF PREFERRED EMBODIMENTS

Figure 2:
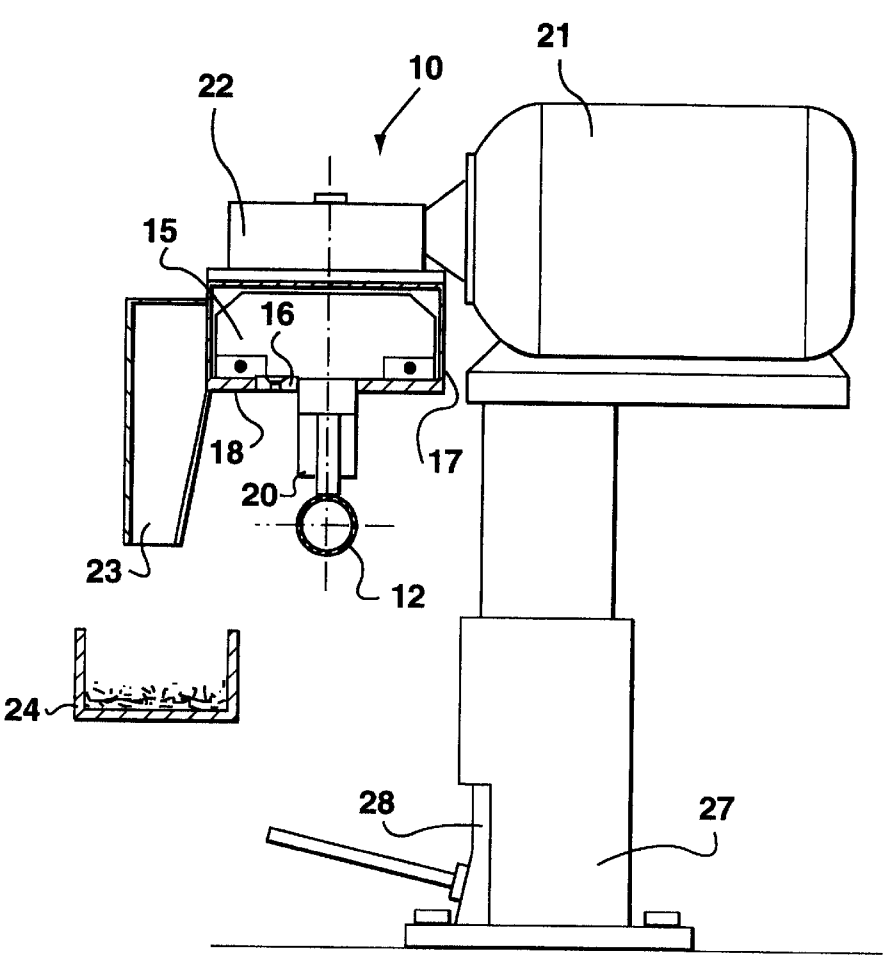
FIG. 2 is a side view of a scarfing and bead chopping apparatus of FIG. 1, partially cut away to reveal a cross-section of the chopper.

FIGS. 1–5 show one embodiment of the chopper 10 of the present invention in combination with a scarfing apparatus 11 for scarfing a longitudinal weld bead from a longitudinally welded tube or tube 12. A scarfing tool 13 is attached to a block 14 on scarfing apparatus 11, in a known manner. The scarfing apparatus 11 may be adjusted so that scarfing tool 13 may be adjusted vertically to accommodate different diameters of tube 12 which are being scarfed, and to lift the scarfing tool over transverse butt welds (not shown).

Figure 3:
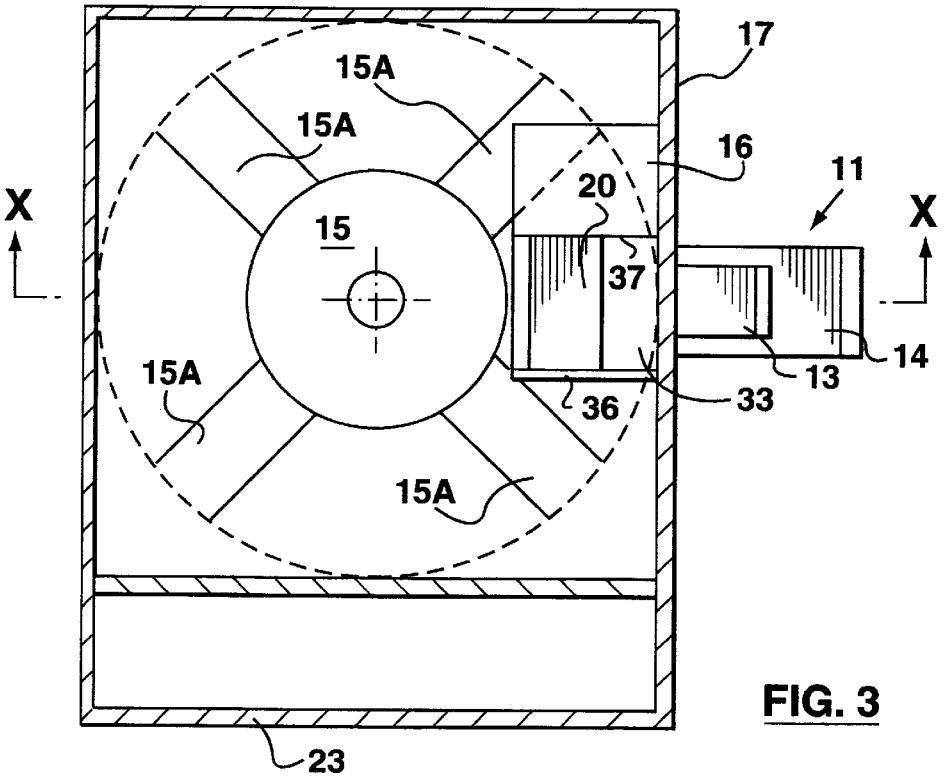
FIG. 3 is a top view of the scarfing and bead chopper of FIG. 1, with a top removed to reveal the inside of the chopper.

The chopper 10 comprises a rotatable cutter 15 and a stationary blade 16 within a chopper housing 17. FIG. 3 shows rotatable cutter 15 with four blades 15A. Although not shown in the drawings, the moving blade may be a reciprocating blade. There is a heat resistant floor 18 to chopper housing 17, in which there is a mouth 33 which leads into throat 19. Throat 19 is located adjacent to and upstream from scarfing tool 13. Throat 19 has a first guide 35 which is adjacent to scarfing tool 13. First guide 35 may be attached to scarfing tool 13, e.g. bolted thereto, or may be independent of scarfing tool and be attached to the walls of throat 19. Throat 19 also has a scarf bead deflector 20 (the second guide) which faces scarfing tool 13. Rotatable cutter 15 is driven by motor 21 through gear reducer 22. Chopper housing 17 also has a chute 23 which extends downwardly towards a collection box 24. The mouth 33 and throat 19 are substantially larger in cross-section than the cross-section of scarfed bead 25. However, throat 19 is not so large that the scarfed bead 25 has the opportunity to curl uncontrollably. Side walls 36 and 37 help to prevent uncontrolled curling from side to side and thus aid in directing weld bead upwards towards the chopper. In addition, the distance between the upper surface 26 of the tube 12 and the cooperating chopping surfaces of rotatable cutter 15 and stationary blade 16 is kept as small as possible, e.g. less than 50 mm and preferably less than 25 mm. This is particularly important for thin scarfed weld beads because of their propensity to curl uncontrollably.

Figure 1:
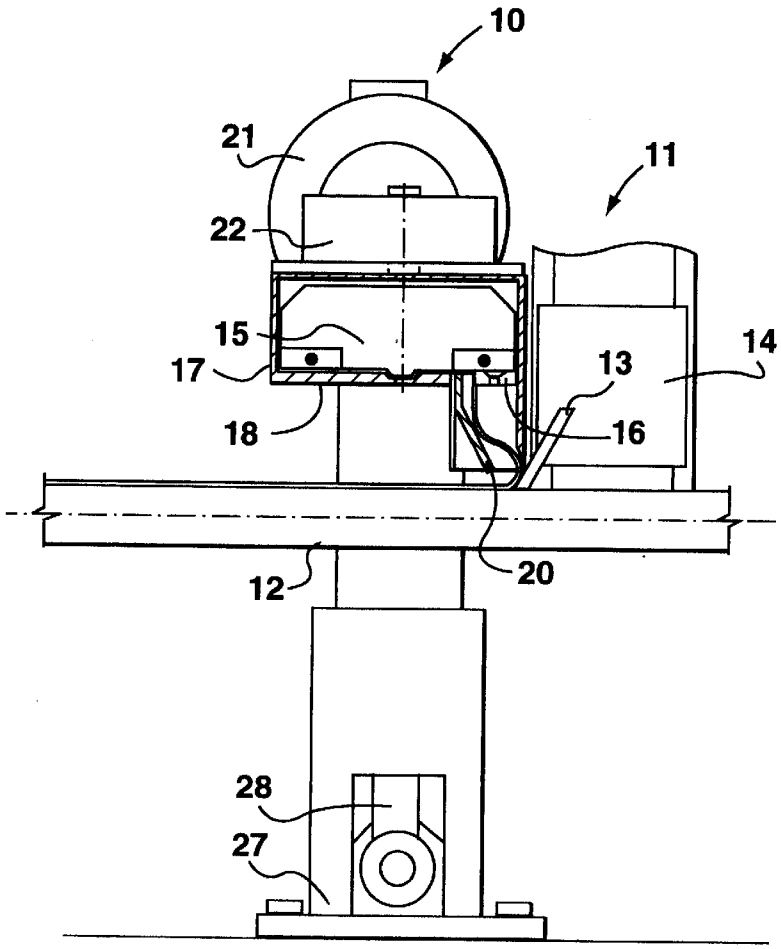
FIG. 1 is a front view of a scarfing and bead chopping apparatus of the present invention, partially cut away to reveal a cross-section of the chopper.

As will be seen in FIGS. 1 and 2, motor 21 is situated on a chopper stand 27, which has a jack 28 incorporated therein. Scarf chip collection box 24 may rest, below chute 23, on a table 29 or a conveyor, as is appropriate.

Figure 5:
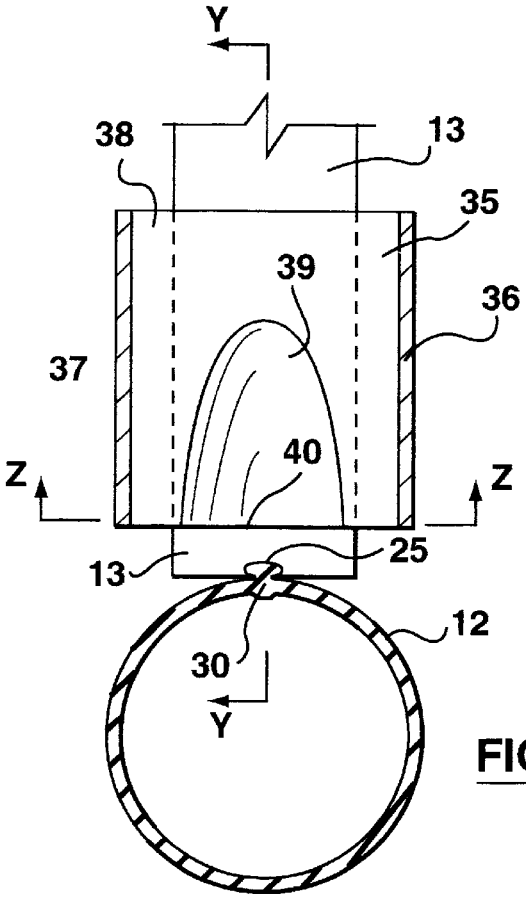
FIG. 5 is a front view of a scooped guide, and scarfing tool and a cross-sectional view of a longitudinally welded tube.
Figure 5A:
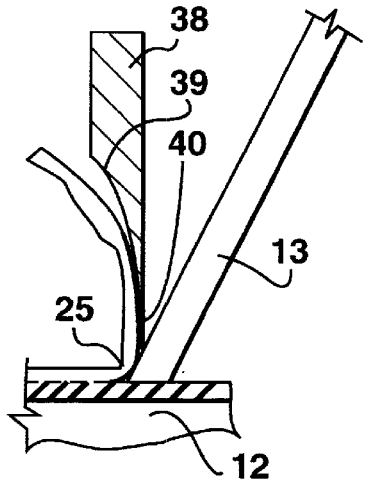
FIG. 5A is a cross-sectional view through line Y—Y in FIG. 5.
Figure 6:
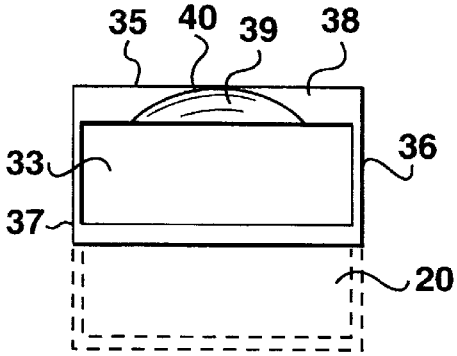
FIG. 6 is a view of a throat of a guide of FIG. 5, viewed from the bottom, in the direction of arrows Z—Z.
Figure 7:
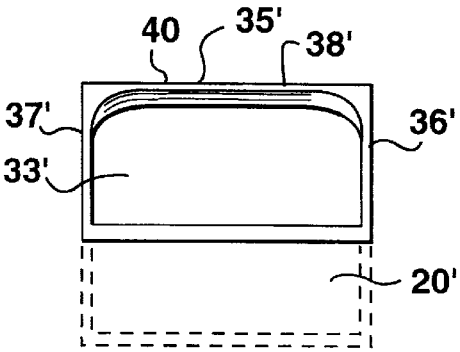
FIG. 7 is a view of a throat of another guide, from a view similar to that of FIG. 6.

FIGS. 5, 5A and 6 shows first guide 35, which has side walls 36 and 37, and wall 38. Wall 38 has a scoop 39 therein which helps to guide scarfed weld bead 25 away from scarfing tool 13 and towards scarf bead deflector 20. It will be noted that edge 40, which is adjacent to scarfing tool 13, is narrow or sharp in order to ensure smooth guiding of the scarfed weld bead from the scarfing tool 13. The scoop 39 then guides the scarfed weld bead towards the second guide, i.e. scarf bead deflector 20. Scoop 39 is particularly useful in guiding thin scarfed weld bead, e.g. up to about 6 mm wide, because it tends to confine the direction in which the scarfed weld bead 25 travels. FIG. 7 shows a cross-section of a second guide 35' which is suitable for larger scarfed weld bead, e.g. above about 8 mm wide. As will be seen, there is no scoop in first guide 35'. Tapered wall 38', with a sharp edge 40', meets side walls 36' and 37' with rounded corners.

Figure 4:
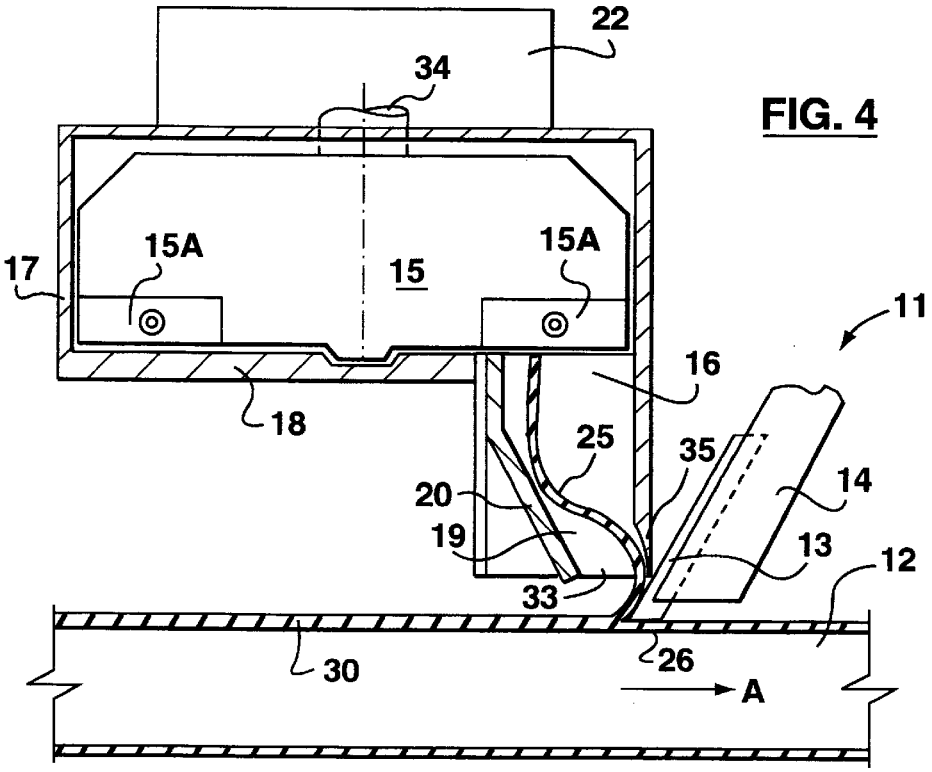
FIG. 4 is cross-sectional view of the chopping apparatus of FIG. 3, along line X—X.

In operation, tube 12 is moved in the direction shown by arrow A (see FIG. 4). Tube 12 has been formed from a flat strip of metal with two longitudinal edges. The flat strip is formed into tubular form, e.g. a circular tube, in a known manner, and the two longitudinal edges are welded together, e.g. by electric welding methods. The welded joint leaves a weld bead 30, as shown in FIG. 4. In order to provide a smooth finish to the tube 12, the weld bead is stripped off with scarfing tool 13. The scarfed bead 25 is forced upwardly by scarfing tool 13. The first guide tends to scoop the scarfed weld bead 25 away from the scarfing tool and towards scarf bead deflector 20, i.e. the second guide. Scarf bead deflector 20 is sloped so that the scarfed weld bead 25 is directed upwardly towards the chopping surfaces of rotating blades 15A and stationary blade 16. Walls 36 and 37 of throat 19 further confine the scarfed weld bead 25 and prevent the weld bead from flailing uncontrollably from side to side.

Mouth 33 and throat 19 are sufficiently wide to allow the scarfed bead 25 to enter and travel without jamming in the throat. Throat 19 is sufficiently narrow, however, to prevent the hot scarfed bead from curling over on itself and either exiting from mouth 33 or buckling into a tangled mass within the throat. As indicated before, guide 35, deflector 20 and walls 36 and 37 are arranged to guide the scarfed bead 25 towards the chopping area of rotatable chopper 15 and stationary blade 16. Preferably, the first guide 35 and the throat 19 are adjustable so that the scarfed bead can be deflected towards the cutters over a very short distance. A short distance is between the tube 12 and the cutting surfaces of the chopper is particularly important for thin scarfed weld beads because of their propensity for wandering uncontrollably, with a tendency not to move directly upwards towards the chopper.

The motor 21 and gear reducer 22 are selected so that the rate of rotation of rotatable chopper 15 is from about 150 rpm to 500 rpm. Typically the motor has a rating 1–5 horsepower and the gear reducer has a reduction ratio of from about 1:2 to 1:20, especially from 1:5 to 1:10.

The scarfed bead is chopped into chips by the cutter, and the chips are flung towards an angled chute 23 to ensure that the chips bounce downwardly and away from the tube 12. The chips fall by gravity, through chute 23 into open-topped collection box 24.

The rotary chopper has a rotational axis which is substantially perpendicular to the longitudinal axis of tube 12. This allows the chopping surfaces between the rotatable chopper 15 and the stationary blade 16 to be very close to the top 26 of tube 12. As indicated above, minimization of this distance is important to minimize the opportunity for the scarfed bead 25 to curl and jam the throat or the chopper. In practice, generally, the longitudinal direction of the tube is horizontal the rotational axis of the chopper is vertical.

A reciprocatory chopper may be used instead of a rotary chopper. While adequate for many applications, a rotary chopper can be operated at higher speeds.

The invention may also be understood by reference to the following example:

EXAMPLE I

A chopping apparatus was constructed similar to that shown in FIGS. 1 to 4. The rotary cutter was about 12.5 cm in diameter by 10 cm high with square shaped blades about 4.8 cm thick. The cutter was driven by a 2 horsepower motor with a 1:5 gear reducer. The cutting head rotated at about 350 rpm. The distance between the tube to the chopping surfaces was about 48 mm. The throat was 19 mm by 38 mm mouth opening and about 35 mm high.

A tube of 12.7 cm diameter with wall thickness of 3.8 mm was longitudinally welded at a rate of 38 meters of tube per minute. The weld bead was thus scarfed at the same rate. The chopping apparatus produced weld bead chips of about 28 mm long, which were deposited in a collection box below the tube. The chopping apparatus was in continuous operation for about 16 hours without interruption and without jamming. This compares with manual methods of operation where scarfed bead coils must be disposed of every 20 to 25 minutes and the weld bead must be re-wound around a winder.

It is common practice in the industry to sell tube without butt welds. Every time a butt weld approaches the scarfing tool, the scarfing tool is lifted out of contact with the weld bead, partly to minimize the possibility of breakage of the scarfing tool. As will be apparent, every time the scarfing tool is lifted out of the way, the scarfed weld bead is broken and a new end must be wound round a scarf winder. The present invention overcomes this necessity and provides automatic threading of the scarfed weld bead into throat 19 and thus to the chopper.

What is claimed is:

1. A weld bead chopper for use in combination with a scarfing tool which is intended to scarf a longitudinal weld bead from a tube, said chopper having a) a moving and a stationary blade, the cooperating and chopping surfaces of which are a short distance from the weld bead, wherein the motion of the moving blade is in a plane which is perpendicular to a line which passes through a longitudinal axis of the tube and the weld bead, and b) an enclosed throat which has walls to guide a scarfed weld bead towards the cooperating chopping surfaces, said throat having a first guide adjacent to the scarfing tool, for directing scarfed weld bead towards a second guide which faces the scarfing tool and is adapted to guide the scarfed weld bead towards the cooperating chopping surfaces, and wherein the enclosed throat has a cross-sectional area substantially larger than the cross-sectional area of the scarfed weld bead and having a mouth which is sufficiently small to prevent the scarfed weld bead from exiting from a mouth of the throat.

2. A weld bead chopper according to claim 1 wherein the movable chopper blade is rotatable about an axis which is substantially perpendicular to a longitudinal axis of the tube.

3. A weld bead chopper according to claim 1 wherein the movable chopper blade is a reciprocating blade.

4. A weld bead chopper according to claim 1 wherein the first guide has a wall which tapers to a sharp edge adjacent to the scarfing tool.

5. A weld bead chopper according to claim 2 wherein the first guide has a wall which tapers to a sharp edge adjacent to the scarfing tool.

6. A weld bead chopper according to claim 5 wherein the first guide has a scooped wall adjacent to the scarfing tool.

7. A weld bead chopper according to claim 6 wherein the first guide has a scooped wall adjacent to the scarfing tool.

8. A weld bead chopper according to claim 1 wherein the distance between the cooperating chopping surfaces and the weld bead on the tube is less than about 100 mm.

9. A weld bead chopper according to claim 2 wherein the distance between the cooperating chopping surfaces and the weld bead on the tube is less than about 100 mm.

10. A weld bead chopper according to claim 4 wherein the distance between the cooperating chopping surfaces and the weld bead on the tube is from 20 to 50 mm.

11. A weld bead chopper according to claim 5 wherein the distance between the cooperating chopping surfaces and the weld bead on the tube is from 20 to 50 mm.

12. A weld bead chopper according to claim 6 wherein the distance between the cooperating chopping surfaces and the weld bead on the tube is from 20 to 50 mm.

13. A weld bead chopper according to claim 7 wherein the distance between the cooperating chopping surfaces and the weld bead on the tube is from 20 to 50 mm.

14. A weld bead chopper according to claim 1 in which the weld bead chopper has a chute wherein chopped weld bead may exit.

15. A weld bead chopper according to claim 2 in which the weld bead chopper has a chute wherein chopped weld bead may exit.

16. A process for disposing of a scarfed weld bead from a longitudinally welded tube comprising:

a) scarfing the weld bead from the tube;

b) directing the scarfed weld bead away from the scarfing tool and towards a chopper which has a moving and a stationary blade, the cooperating and chopping surfaces of which are a short distance from the weld bead, wherein the motion of the moving blade is in a plane which is perpendicular to a line which passes through a longitudinal axis of the tube and the weld bead, wherein direction of the scarfed weld bead is accomplished by movement of the scarfed weld bead through an enclosed throat which has walls to guide a scarfed weld bead towards the cooperating chopping surfaces, said throat having a first guide adjacent to the scarfing tool, which directs the scarfed weld bead towards a second guide which faces the scarfing tool and is adapted to guide the scarfed weld bead towards the cooperating chopping surfaces, and wherein the throat has a cross-sectional area substantially larger than the cross-sectional area of the scarfed weld bead and having a mouth which is sufficiently small to prevent the scarfed weld bead from exiting from a mouth of the throat; and c) chopping the scarfed weld bead with the moving and stationary blades.

17. A process according to claim 16 wherein the movable blade is rotatable about an axis which is substantially perpendicular to a longitudinal axis of the tube.

18. A process according to claim 16 wherein the distance between the tube and the chopping surfaces is less than about 100 mm.

19. A process according to claim 16 wherein the distance between the tube and the chopping surfaces are from 20 to 50 mm.

20. A process according to claim 17 wherein the distance between the tube and the chopping surfaces are from 20 to 50 mm.

21. A process according to claim 16 wherein chopped weld bead exits from the chopper through a chute.

* * * * *